US009338847B2

(12) United States Patent
Ryu et al.

(10) Patent No.: US 9,338,847 B2
(45) Date of Patent: May 10, 2016

(54) LIGHT DRIVING APPARATUS AND DRIVING METHOD THEREFOR

(71) Applicant: SAMSUNG ELECTRO-MECHANICS CO., LTD., Suwon, Gyunggi-do (KR)

(72) Inventors: Byoung Woo Ryu, Gyunggi-do (KR); Kyu Tae Seo, Gyunggi-do (KR); Dae Hoon Choi, Gyunggi-do (KR); Ki Hong Kim, Gyunggi-do (KR); Min Jin Kim, Gyunggi-do (KR)

(73) Assignee: SOLUM CO., LTD, Suwon-Si (KR)

( * ) Notice: Subject to any disclaimer, the term of this patent is extended or adjusted under 35 U.S.C. 154(b) by 216 days.

(21) Appl. No.: 13/929,343

(22) Filed: Jun. 27, 2013

(65) Prior Publication Data

US 2014/0167609 A1 Jun. 19, 2014

(30) Foreign Application Priority Data

Dec. 18, 2012 (KR) ..... 10-2012-0148515

(51) Int. Cl.
*H05B 33/08* (2006.01)

(52) U.S. Cl.
CPC ..... *H05B 33/0848* (2013.01)

(58) Field of Classification Search
CPC H01J 29/003; H01J 2229/0015; H01T 13/05; H05B 33/0848
USPC ..... 315/85
See application file for complete search history.

(56) References Cited

U.S. PATENT DOCUMENTS 8,952,632 B2 * 2/2015 Du ..... H05B 33/0818 315/291
2011/0227492 A1 9/2011 Du et al.
2012/0256558 A1 10/2012 Goyal et al.

FOREIGN PATENT DOCUMENTS

CN 101507368 A 8/2009
CN 101848577 A 9/2010
KR 2009-0102948 A 10/2009
KR 2012-0061330 A 6/2012
WO 2008/023341 A2 2/2008

OTHER PUBLICATIONS

Korean Office issued on Jul. 30, 2014 in Korean Patent Application No. 10-2012-0148515 (English Translation).
Chinese Office Action issued in corresponding Chinese Patent Application No. 2013102940591, mailed on Jun. 3, 2015; 16 pages with English translation.
LED Driver Dimming Methods Application Note, http://www.eptronics.com/documents/Dimming%20Methods%20AppNote.pdf; EPtronics(Jan. 9, 2012).

* cited by examiner

*Primary Examiner* — John Poos
*Assistant Examiner* — David Mattison
(74) *Attorney, Agent, or Firm* — McDermott Will & Emery LLP

(57) ABSTRACT

There are provided a light driving apparatus capable of being commonly used in various types of dimmers, and a driving method therefor. The light driving apparatus includes: a driving unit supplying driving power to a light emitting device according to controlling to drive the light emitting device; and a general-purpose dimming controlling unit controlling dimming of the light emitting device by converting a range of a brightness control signal of an external dimmer into a first voltage range according to a preset ratio to control the supply of power from the driving unit.

7 Claims, 8 Drawing Sheets

| DIMMER | MAXIMUM [V] | MINIMUM [V] |
|---|---|---|
| SOURCE DIMMER | 10V | 1V |
| DIMMING RATIO | 100% | 10% |

FIG. 2A

| TYPE OF DIMMER | MAXIMUM [KΩ] | MAXIMUM [KΩ] |
|---|---|---|
| FIRST SINK DIMMER | 257 | 84 |
| SECOND SINK DIMMER | 200 | 52 |
| THIRD SINK DIMMER | 120 | 32 |
| DIMMING RATIO | 100% | 10% |

FIG. 2B

LIGHT DRIVING APPARATUS AND DRIVING METHOD THEREFOR

CROSS-REFERENCE TO RELATED APPLICATIONS

This application claims the priority of Korean Patent Application No. 10-2012-0148515 filed on Dec. 18, 2012, in the Korean Intellectual Property Office, the disclosure of which is incorporated herein by reference.

BACKGROUND OF THE INVENTION

1. Field of the Invention

The present invention relates to a light driving apparatus that can be used with various types of dimmers, and a driving method therefor.

2. Description of the Related Art

In general, lights are installed in predetermined areas in the interiors of buildings such as offices, hotels, classrooms, and the like, in order to allow for user convenience in the corresponding areas.

As the light, an incandescent light bulb, a fluorescent light bulb, or the like, has been mainly used. Recently, however, a light emitting diode (LED) has been substituted for an incandescent light bulb, a fluorescent light bulb, or the like, due to advantages such as reduced power use, longer effective lifespan, and the like.

Meanwhile, as a driving apparatus for driving the above-mentioned light, a dimmer capable of adjusting brightness, as disclosed in the following Related Art Document, as well as switching the light off and on may be used.

However, such a dimmer may generally use various dimming schemes such as those of a source dimmer and a sink dimmer. In addition, the sink dimmer has various characteristics according to manufacturers, such that it may be difficult to apply the sink dimmer to an appropriate driving apparatus.

Particularly, in the case that the above-mentioned dimmer has already been installed on the ceiling or the wall in the interiors of buildings such as offices, hotels, classrooms, and the like, it may be difficult to change or replace the dimmer, such that a driving apparatus appropriate for a scheme or characteristics of the corresponding dimmer should be detected and applied every time.

RELATED ART DOCUMENT (Patent Document 1) US Patent Application Publication No. 2012-0256558

SUMMARY OF THE INVENTION

An aspect of the present invention provides a light driving apparatus capable of being commonly used with various types of dimmers, and a driving method therefor.

According to an aspect of the present invention, there is provided a light driving apparatus including: a driving unit supplying driving power to a light emitting device according to controlling to drive the light emitting device; and a general-purpose dimming controlling unit controlling dimming of the light emitting device by converting a range of a brightness control signal of an external dimmer into a first voltage range according to a preset ratio to control the supply of power from the driving unit.

The general-purpose dimming controlling unit may convert a voltage range or an impedance range of the brightness control signal of the external dimmer into the first voltage range.

The general-purpose dimming controlling unit may include: a voltage conversion unit converting the voltage range or the impedance range of the brightness control signal of the external dimmer into the first voltage range; and a controlling unit recognizing a type of corresponding dimmer according to the first voltage range from the voltage conversion unit to provide a dimming signal according to the brightness control signal.

The controlling unit may include: a recognizer comparing the first voltage range from the voltage conversion unit with a preset voltage range of a lookup table to recognize the type of corresponding dimmer; and a dimming controller providing the dimming signal according to the brightness control signal based on the type of dimmer recognized by the recognizer.

The dimming controller may control current information of the light emitting device detected by the driving unit to control the dimming of the light emitting device.

The light emitting device may be at least one light emitting diode.

The driving unit may include: a power factor correction unit switching input power to correct a power factor; and a direct current (DC) to DC conversion unit converting DC power from the power factor correction unit into the driving power according to controlling.

The driving unit may further include a filter unit rectifying and smoothing alternating current (AC) power and removing electromagnetic interference therefrom.

The DC to DC conversion unit may include: a converter switching the DC power from the power factor correction unit according to a feedback signal to convert the DC power into the driving power; and a feedback unit detecting current flowing in the light emitting device and providing the detected current to the converter.

According to another aspect of the present invention, there is provided a driving method for a light driving apparatus, including: reading a type of dimmer previously used; and converting a range of a brightness control signal into a first voltage range according to a preset ratio to control the supply of power to a light emitting device, controlling dimming of the light emitting device.

The controlling of the dimming may include: setting a dimming range of a dimmer in a preset lookup table; obtaining data on a connected dimmer; comparing the obtained data with a maximum value and a minimum value of the set dimming range; and changing the dimming range or outputting the dimming data according to the comparison result, thereby controlling the dimming of the light emitting device.

The driving method may further include recording the changed dimming range.

BRIEF DESCRIPTION OF THE DRAWINGS

The above and other aspects, features and other advantages of the present invention will be more clearly understood from the following detailed description taken in conjunction with the accompanying drawings, in which:

FIGS. 2A and 2B are tables showing types of dimmers and characteristic values according to the types of dimmers;

DETAILED DESCRIPTION OF THE EMBODIMENTS

Figure 1:
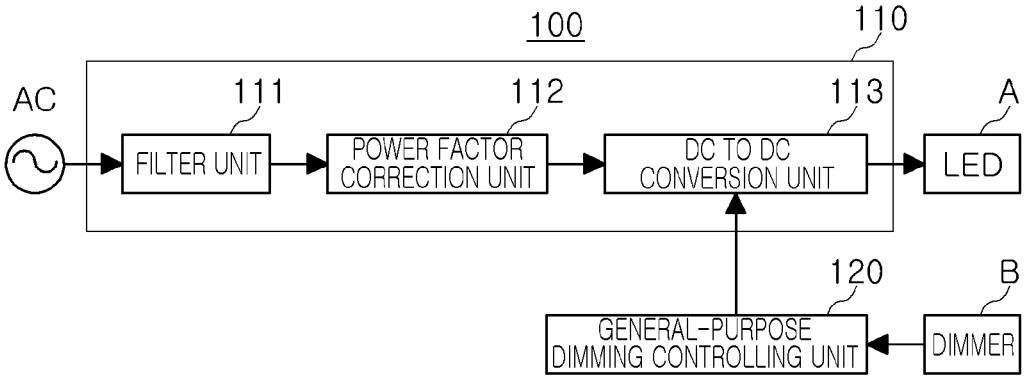
FIG. 1 is a schematic configuration diagram of a light driving apparatus according to an embodiment of the present invention.

Hereinafter, embodiments of the present invention will be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the same or like reference numerals will be used to designate the same or like elements.

FIG. 1 is a schematic configuration diagram of a light driving apparatus according to an embodiment of the present invention.

Referring to FIG. 1, the light driving apparatus 100 according to the embodiment of the present invention may include a driving unit 110 and a general-purpose dimming controlling unit 120.

The driving unit 110 may supply driving power to allow a light emitting device A to emit light, and the light emitting device A may be at least one light emitting diode (LED).

The driving unit 110 may control the supply of the driving power to the light emitting device A such that it may control brightness of the light emitting device A.

To this end, the driving unit 110 may include a filter unit 111, a power factor correction unit 112, and a direct current (DC) to DC conversion unit 113.

The filter unit 111 may rectify and smooth input alternating current (AC) power, remove electromagnetic interference therefrom, and transfer the power in which the electromagnetic interference has been removed to the power factor correction unit 112.

The power factor correction unit 112 may switch the rectified power to correct a phase difference between voltage and current, thereby correcting a power factor, or adjust a current waveform to estimate a voltage waveform, thereby correcting a power factor.

The DC to DC conversion unit 113 may convert the DC power of which the power factor has been corrected by the power factor correction unit 112 into the driving power and then supply the driving power to the light emitting device A. Here, a power level of the driving power may be varied according to controlling.

The general-purpose dimming controlling unit 120 may control the power level of the driving power of the DC to DC conversion unit 113 according to a brightness control signal from an external dimmer B.

Meanwhile, types of the external dimmer B may be various.

FIGS. 2A and 2B are tables showing types of dimmers and characteristic values according to the types of dimmers.

Referring to FIGS. 2A and 2B, a dimming scheme of a dimmer may include a source dimming scheme of using voltage and a sink dimming scheme of using impedance. Here, in the sink dimming scheme, a range of the impedance may be variously set.

That is, as shown in FIG. 2A, in the source dimmer, in the case in which a dimming range is set to 100% to 10%, a voltage value corresponding thereto may be set to 10V to 1V.

On the other hand, as shown in FIG. 2B, the sink dimmer may be divided into first to third sink dimmers of which impedances may be variously set according to manufacturers. In the first to third sink dimmers, even though dimming ratios are differently set to 100% to 10%, impedances may be differently set to 257 Kohm to 84 Kohm, 200 Kohm to 52 Kohm, and 120 Kohm to 32 Kohm, respectively.

Figure 3:
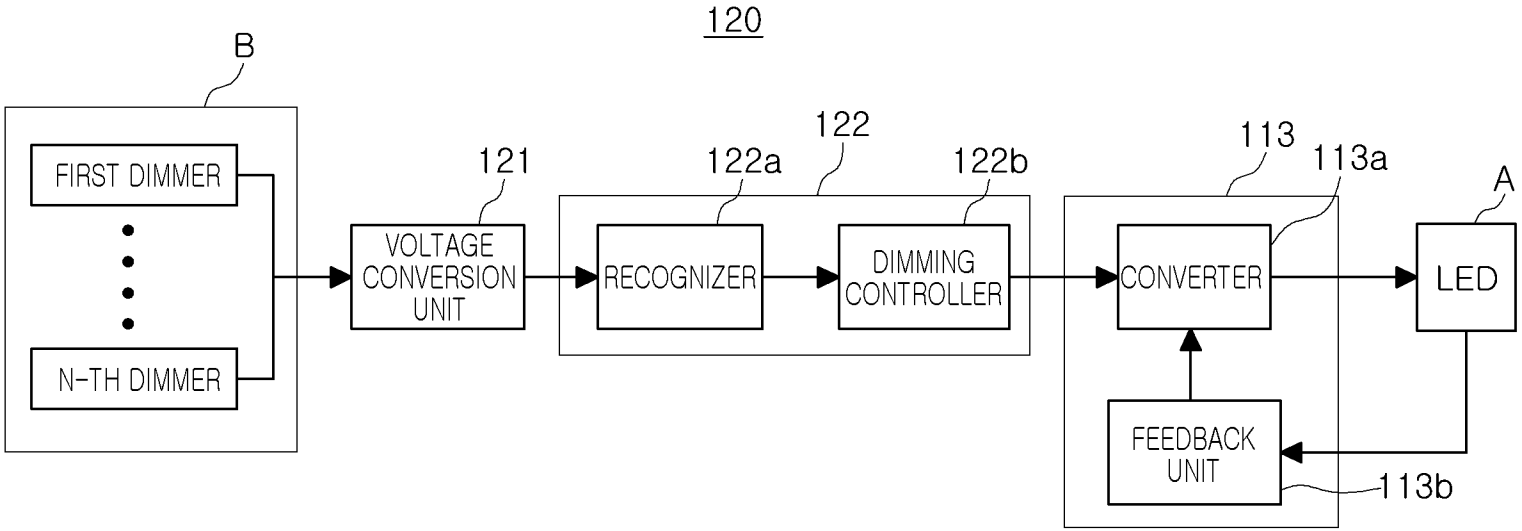
FIG. 3 is a schematic configuration diagram of a general-purpose dimming controlling unit used in the light driving apparatus according to the embodiment of the present invention shown in FIG. 1.

FIG. 3 is a schematic configuration diagram of the general-purpose dimming controlling unit used in the light driving apparatus according to the embodiment of the present invention shown in FIG. 1.

Referring to FIGS. 1 and 3, as described above, in order to generally use the light driving apparatus according to the embodiment of the present invention in various types of dimmers, the general-purpose dimming controlling unit 120 may include a voltage conversion unit 121 and a controlling unit 122.

The voltage conversion unit 121 may convert ranges of brightness control signals from various types of dimmers such as first to n-th dimmers into a first preset voltage range. In this case, since the brightness control signal of the source dimmer includes voltage information, the voltage conversion unit 121 may convert the voltage information into the first voltage range that may be recognized by the controlling unit. In addition, since the brightness control signal of the sink dimmer includes impedance information, the voltage conversion unit 121 may convert the impedance information into the first voltage range that may be recognized by the controlling unit.

The controlling unit 122 may include a recognizer 122*a* and a dimming controller 122*b*.

The recognizer 122*a* may compare the first voltage range from the voltage conversion unit 121 with a preset voltage range of a lookup table to recognize a type of corresponding dimmer.

The dimming controller 122*b* may provide the DC to DC conversion unit 113 with a dimming signal according to the brightness control signal based on the type of dimmer recognized by the recognizer 122*a*.

The DC to DC conversion unit 113 may include a converter 113*a* and a feedback unit 113*b*. The converter 113*a* may switch the DC power from the power factor correction unit 112 according to a feedback signal to convert the DC power into the driving power, and the feedback unit 113*b* may detect current flowing in the light emitting device A and provide the detected current to the converter 113*a*.

That is, the converter 113*a* may control the power level of the driving power according to the current information of the fed-back detection signal, and the dimming controller 122*b* may control the current information of the detection signal transferred from the feedback unit 113*b* to the converter 113*a* to control the power level of the driving power supplied to the light emitting device A, thereby controlling the brightness of the light emitting device A.

Figure 4:
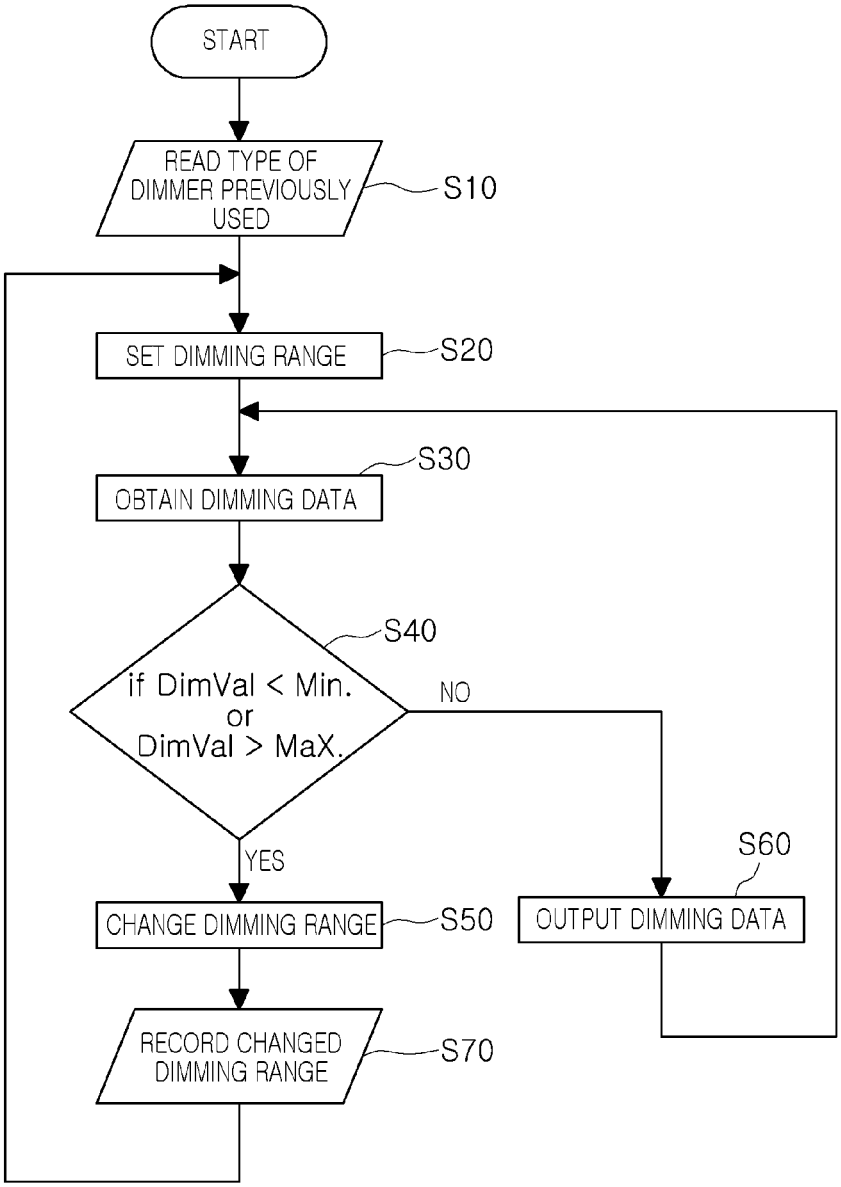
FIG. 4 is a flowchart showing a driving method for alight driving apparatus according to an embodiment of the present invention.

FIG. 4 is a flowchart showing a driving method for a light driving apparatus according to an embodiment of the present invention.

An operation of the general-purpose dimming controlling unit 120 of FIG. 3 will be described in more detail with reference to FIG. 4.

First, the general-purpose dimming controlling unit 120 may read a type of dimmer previously used that is stored in a lookup table (S10).

Then, the general-purpose dimming controlling unit 120 may convert a range of a brightness control signal from a dimmer connected thereto into a first voltage range according to a preset ratio to control the supply of power to the light emitting device, thereby controlling the dimming of the light emitting device (S20 to S70).

More specifically, the controlling (S20 to S70) of the dimming of the light emitting device may include setting a dimming range of a dimmer in a preset lookup table (S20), obtaining data on the connected dimmer (S30), comparing the obtained data with a maximum value and a minimum value of the set dimming range (S40), and changing the dimming range (S50) or and outputting the dimming data (S60) according to the comparison result, thereby controlling the dimming of the light emitting device.

In the case in which the dimming range is changed, the changed dimming range may be recorded (S70).

FIGS. 5A through 5D are graphs showing dimming control results of various types of dimmers by the light driving apparatus according to the embodiment of the present invention.

Figure 5A:
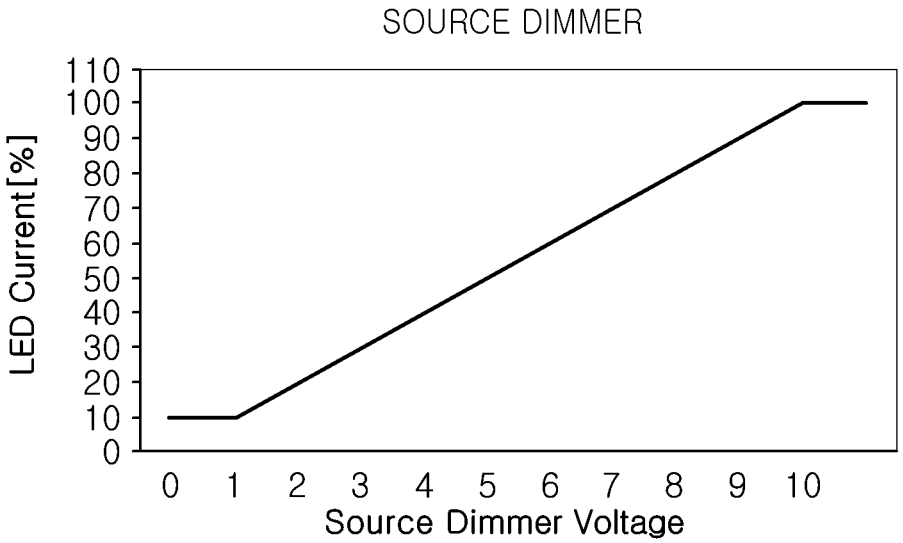
FIGS. 5A through 5D are graphs showing dimming control results of various types of dimmers by a light driving apparatus according to an embodiment of the present invention.

Referring to FIGS. 5A through 5D, as shown in FIG. 5A, in the case of the source dimmer, it may be appreciated that a dimming control is performed at 10% to 100%.

Figure 5B:
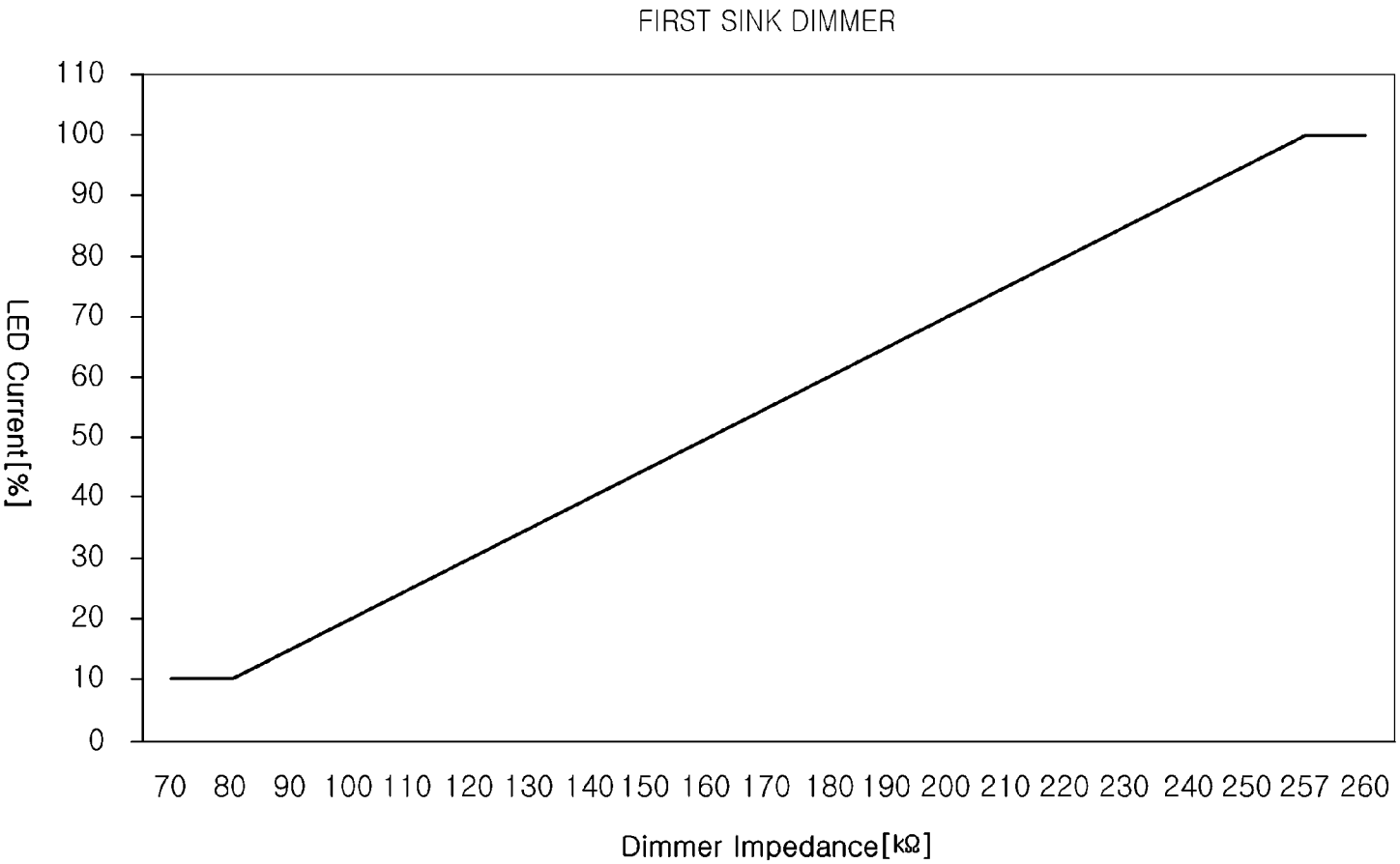
Figure 5C:
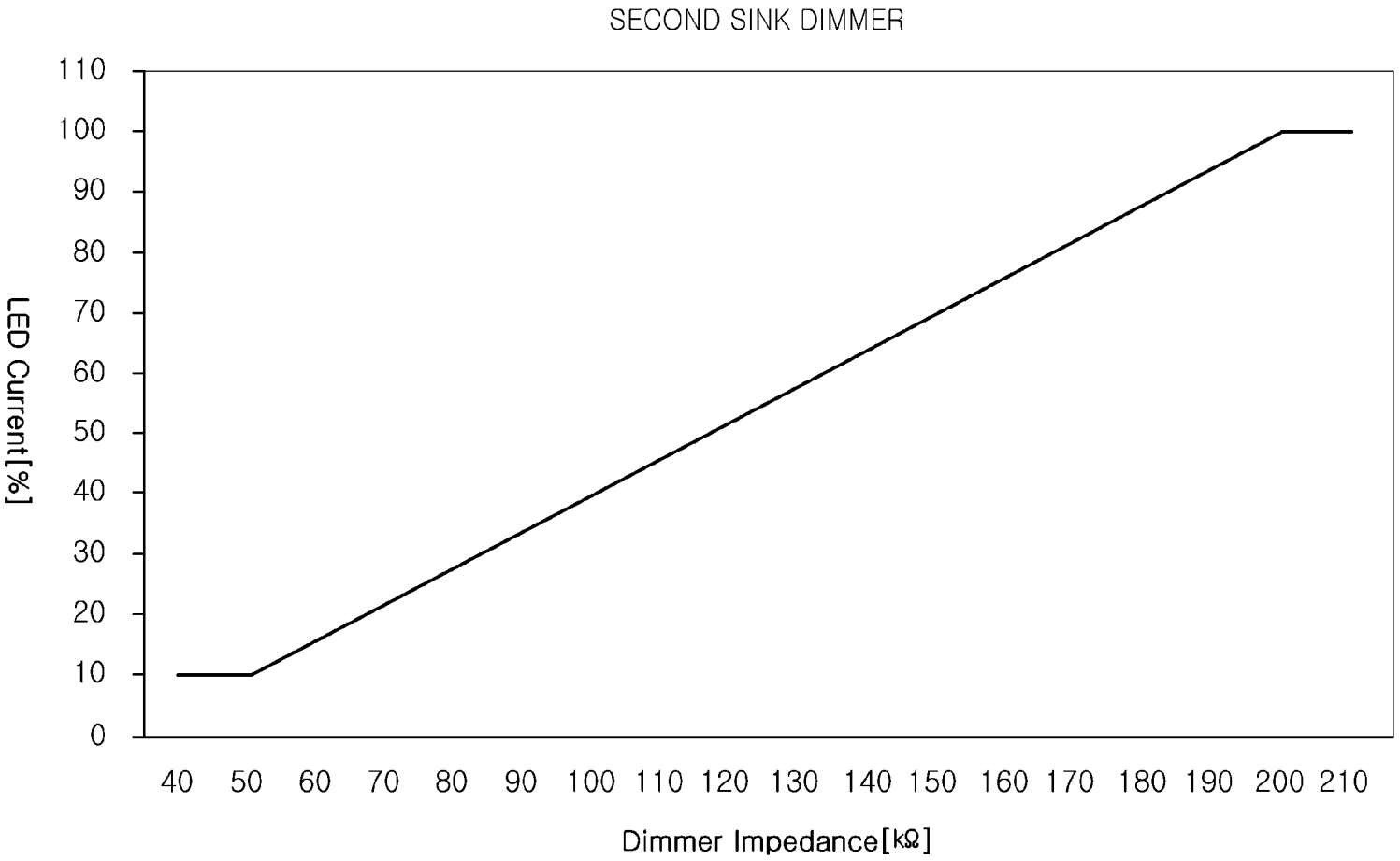
Figure 5D:
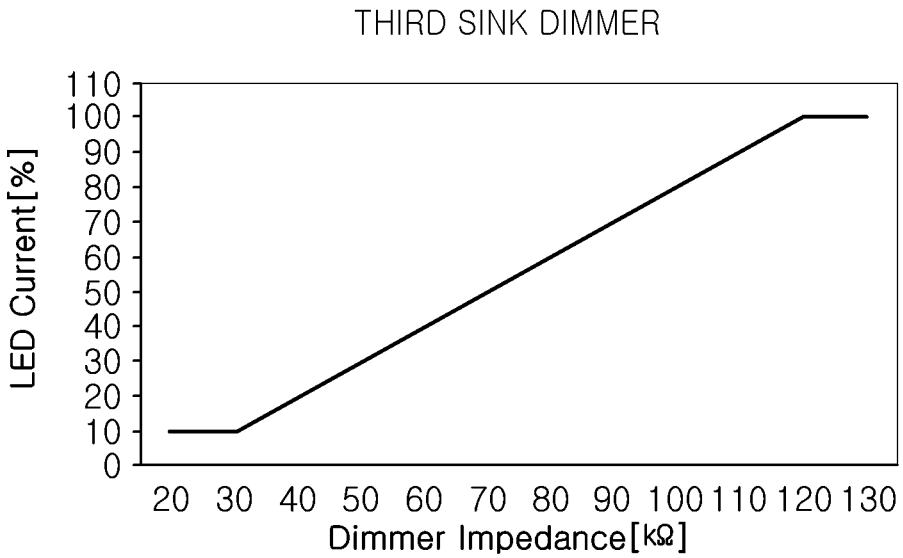

Likewise, as shown in FIGS. 5B through 5D, in the case of the first to third sink dimmers, it may be appreciated that a dimming control is smoothly performed at 10% to 100%.

As set forth above, according to the embodiments of the present invention, the dimming range is set according to the voltage value, or the range of the brightness control signal from various types of dimmers is set to the first voltage range according to the impedance value, whereby the light driving apparatus may be commonly used in the dimmers having various characteristic values.

While the present invention has been shown and described in connection with the embodiments, it will be apparent to those skilled in the art that modifications and variations can be made without departing from the spirit and scope of the invention as defined by the appended claims.

What is claimed is:

1. A light driving apparatus comprising:

a driving unit supplying driving power to a light emitting device according to controlling to drive the light emitting device; and a general-purpose dimming controlling unit controlling dimming of the light emitting device by converting a range of a brightness control signal of an external dimmer into a first voltage range according to a preset ratio to control the supplying of the driving power from the driving unit, wherein the general-purpose dimming controlling unit converts a voltage range or an impedance range of the brightness control signal of the external dimmer into the first voltage range, wherein the general-purpose dimming controlling unit includes:

a voltage conversion unit converting the voltage range or the impedance range of the brightness control signal of the external dimmer into the first voltage range; and a controlling unit recognizing that a type of corresponding dimmer according to the first voltage range from the voltage conversion unit is a source dimmer or a sink dimmer, to provide a dimming signal according to the brightness control signal based on the dimmer type.

2. The light driving apparatus of claim 1, wherein the controlling unit includes:

a recognizer comparing the first voltage range from the voltage conversion unit with a preset voltage range of a lookup table to recognize the type of corresponding dimmer; and a dimming controller providing the dimming signal according to the brightness control signal based on the type of dimmer recognized by the recognizer.

3. The light driving apparatus of claim 2, wherein the dimming controller controls current information of the light emitting device detected by the driving unit to control the dimming of the light emitting device.

4. The light driving apparatus of claim 1, wherein the light emitting device is at least one light emitting diode.

5. The light driving apparatus of claim 1, wherein the driving unit includes:

a power factor correction unit switching input power to correct a power factor; and a direct current (DC) to DC conversion unit converting DC power from the power factor correction unit into the driving power according to controlling.

6. The light driving apparatus of claim 5, wherein the driving unit further includes a filter unit rectifying and smoothing alternating current (AC) power and removing electromagnetic interference therefrom.

7. The light driving apparatus of claim 5, wherein the DC to DC conversion unit includes:

a converter switching the DC power from the power factor correction unit according to a feedback signal to convert the DC power into the driving power; and a feedback unit detecting current flowing in the light emitting device and providing the detected current to the converter.

* * * * *